US005196825A

United States Patent [19]

Young

[11] Patent Number: 5,196,825

[45] Date of Patent: Mar. 23, 1993

[54] PERSONAL SECURITY APPARATUS

[76] Inventor: James T. Young, 8809 Cross Mountain Trl., San Antonio, Tex. 78255

[21] Appl. No.: 807,713

[22] Filed: Dec. 16, 1991

[51] Int. Cl.[5] ..... G08B 1/08; G08B 23/00

[52] U.S. Cl. ..... 340/539; 340/573; 455/100

[58] Field of Search ..... 340/539, 531, 572, 573; 455/7, 9, 100

[56] References Cited

U.S. PATENT DOCUMENTS

| | | | |
|---|---|---|---|
| 4,598,272 | 7/1986 | Cox | 340/573 |
| 4,792,796 | 12/1988 | Bradshaw et al. | 340/573 |
| 4,853,692 | 8/1989 | Wolk et al. | 340/573 |
| 4,924,211 | 5/1990 | Davies | 340/573 |

*Primary Examiner*—Donnie L. Crosland
*Attorney, Agent, or Firm*—W. Kirk McCord

[57] ABSTRACT

An apparatus is provided for monitoring the location of a person and for determining whether the person is in distress. The apparatus includes a transmitter and a transceiver, which are adapted to be worn at different locations on the person's body. The transmitter normally transmits a first electromagnetic signal, which is detectable by the transceiver and by at least one remote receiver. When the person is in distress, the transmitter transmits a second electromagnetic signal in lieu of the first signal. The transceiver is responsive to the second signal for generating a third electromagnetic signal, which also indicates that the person is in distress. The remote receiver is responsive to either or both of the second and third signals for generating an alarm signal indicating the distress condition. The transceiver also generates the third signal in response to the absence of the first signal, which may occur when the transmitter is removed from the person's body and the distance between the transmitter and transceiver becomes too great for the transceiver to receive the first signal, or due to transmitter malfunctional. The third signal therefore provides a redundancy feature in the event of failure of the transmitter to generate the second signal. The apparatus not only allows the person's location to be continuously monitored, but also indicates when the person is in need of assistance.

20 Claims, 7 Drawing Sheets

PERSONAL SECURITY APPARATUS

FIELD OF THE INVENTION

This invention relates generally to electronic signal transmitters and receivers and in particular to an apparatus which includes a body mountable device for transmitting a warning signal when the wearer is in distress.

BACKGROUND OF THE INVENTION

The startling increase in the number of persons being abducted, particularly young children, has increased public awareness of the need for personal security. Parents are concerned about the safety of their children and are reluctant to leave their children unattended, even for short periods of time.

DESCRIPTION OF THE PRIOR ART

The so-called "homing" devices are often used by law enforcement personnel to monitor the location of a person or an item. Typically, the homing device is carried at a non-conspicuous location on the person or item being tracked and the device emits a constant signal at a selected frequency, which is detectable by a remote receiver tuned to the selected frequency. The strength of the signal usually indicates the distance between the transmitter and the receiver. By continually monitoring the homing signal, the location of the person or item can be continuously monitored.

Although homing devices can be used to continuously monitor the location of a person, they do not indicate whether or not the person is in distress. There is therefore a need for a personal security apparatus, which includes a transmitter adapted to be worn by individuals, including children, whereby the wearer's location can be continuously monitored and a warning signal generated when the wearer is in distress.

DISCLOSURE OF THE INVENTION

In accordance with the present invention, a personal security apparatus is comprised of first and second devices mountable at respective first and second locations on a person's body. The first device includes a transmitter for normally transmitting a first electromagnetic signal and for transmitting a second electromagnetic signal in lieu of the first signal in response to a first predetermined condition. The second device includes a transceiver for receiving the first and second signals and for transmitting a third electromagnetic signal in response to a second predetermined condition. The second predetermined condition is indicated by either the second signal being received by the transceiver or the first signal not being received by the transceiver. At least the second and third signals are detectable by a receiver at a remote location.

In accordance with a unique feature of the invention, the third signal is generated either in the absence of the first signal or in response to the second signal being transmitted, which provides a redundant transmission capability. When the apparatus is used as a personal security apparatus, the first signal indicates a normal condition. The second signal, however, indicates an abnormal or distress condition. A remote receiver tuned to the frequency of the second signal generates an alarm signal in response to the second signal, to alert another person at the site of the remote receiver, so that help can be promptly dispatched. The third signal also indicates an abnormal or distress condition. As long as the second signal is being transmitted, the third signal is not needed. However, in the absence of the second signal, such as may result from damage to or malfunction of the first device, the third signal is needed to indicate the distress condition.

In the preferred embodiment, the first device has first and second electrical circuits, which are used to control the first transmitter to transmit the second signal. The first electrical circuit includes an electrical conductor housed in an insulative jacket, which is adapted to be worn around a part of the person's body. The second electrical circuit includes a manually operable switch. The first electrical circuit is normally closed and the second electrical circuit is normally open. For example, the first device may be worn like a brooch, suspended from the person's neck by the insulative jacket, which is worn around the person's neck. The manually operable switch is preferably located on the first device.

If the insulative wire inside the jacket is broken, the first electrical circuit is open and the first device transmits the second signal in lieu of the first signal. Similarly, when the person manually operates the switch, the second electrical circuit is closed, which also results in the second signal being transmitted. For example, one who is attempting to kidnap a child may forcibly remove the first device from the child's neck, which is likely to result in the electrical conductor being broken and the second signal being transmitted. Alternatively, the child may activate the first device to transmit the second signal by closing the switch.

The second device is preferably mounted at a non-conspicuous location on the person's body. The second device transmits the third signal in response to the second signal, or in response to the absence of the first signal. Therefore, the second device provides a back-up capability in the event of first transmitter malfunction.

The person's location can be continually monitored from the site of the remote receiver by tracking either or both of the second and third signals. One of the remote receivers is preferably located at the person's residence, so that a family member can monitor his whereabouts. Other remote receivers may be located at other locations, such as police stations, so that the police can take prompt action after receiving the distress signals, without having to be first notified by a family member.

DETAILED DESCRIPTION OF THE PREFERRED EMBODIMENT

Figure 1:
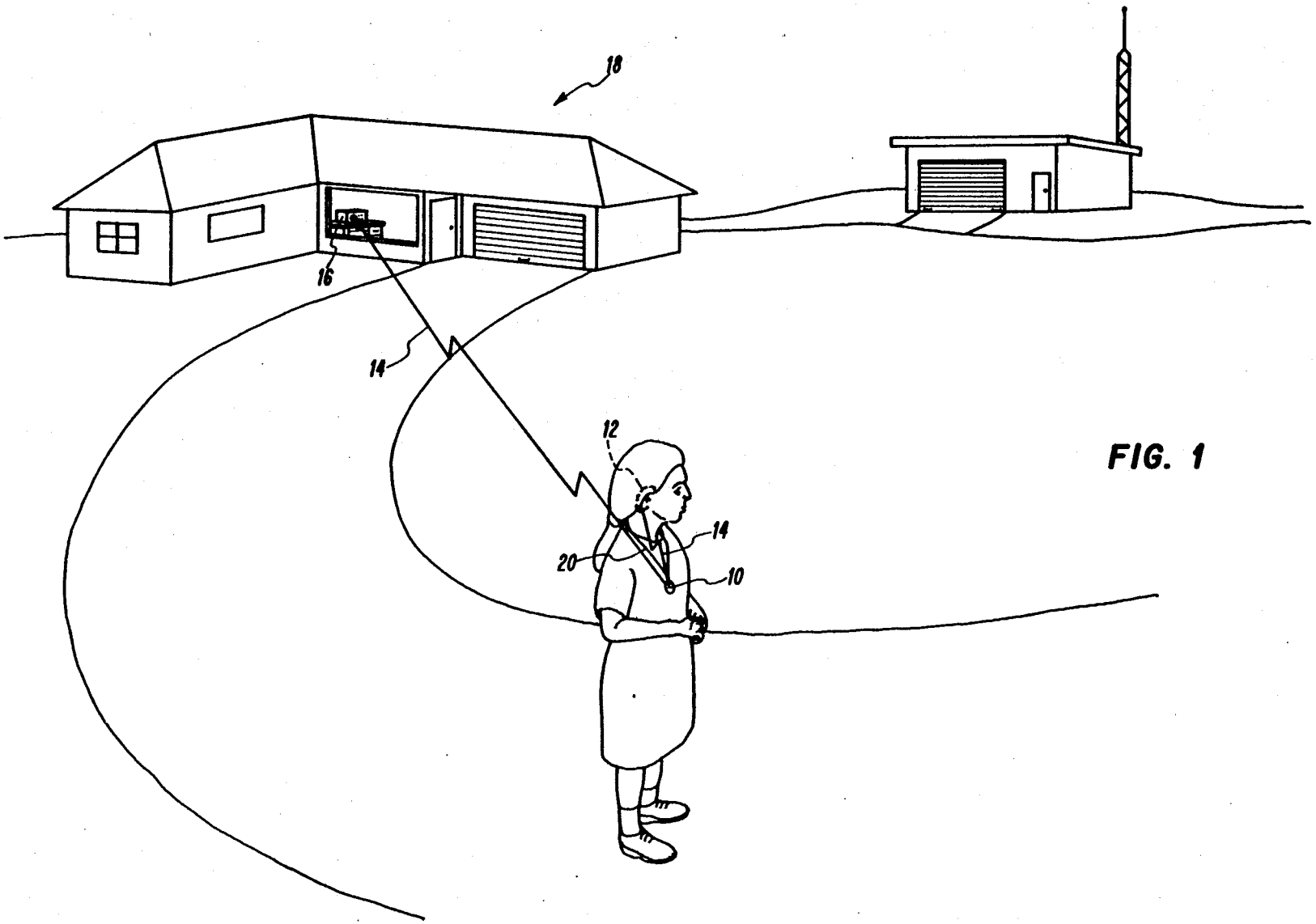
FIG. 1 illustrates a personal security apparatus, according to the present invention, being worn by a child, with the apparatus transmitting a first signal indicating a normal condition.

In the description which follows, like parts are marked throughout the specification and drawings with the same respective reference numerals. The drawings are not necessarily to scale and in some instances proportions may have been exaggerated in order to more clearly depict certain features of the invention.

Referring now to FIG. 1, a personal security apparatus is comprised of first and second devices, which are adapted to be worn by a person, such as the child shown in FIG. 1. The first device includes a transmitter 10, which may be worn around the child's neck in the manner of a brooch. The second device includes a transceiver 12, which is preferably mounted at a non-conspicuous location, such as behind the child's ear. Transmitter 10 normally transmits a first electromagnetic signal 14. Transceiver 12 includes a receiver for receiving first signal 14. A receiver console 16 is located at a remote location, such as at the child's home 18, for receiving first signal 14. First signal 14 indicates a normal condition and allows the child's location to be continuously monitored from the site of the receiver console 16. By means of receiver console 16, a family member or other person at the child's home 18 can continually monitor the child's location.

Figure 2:
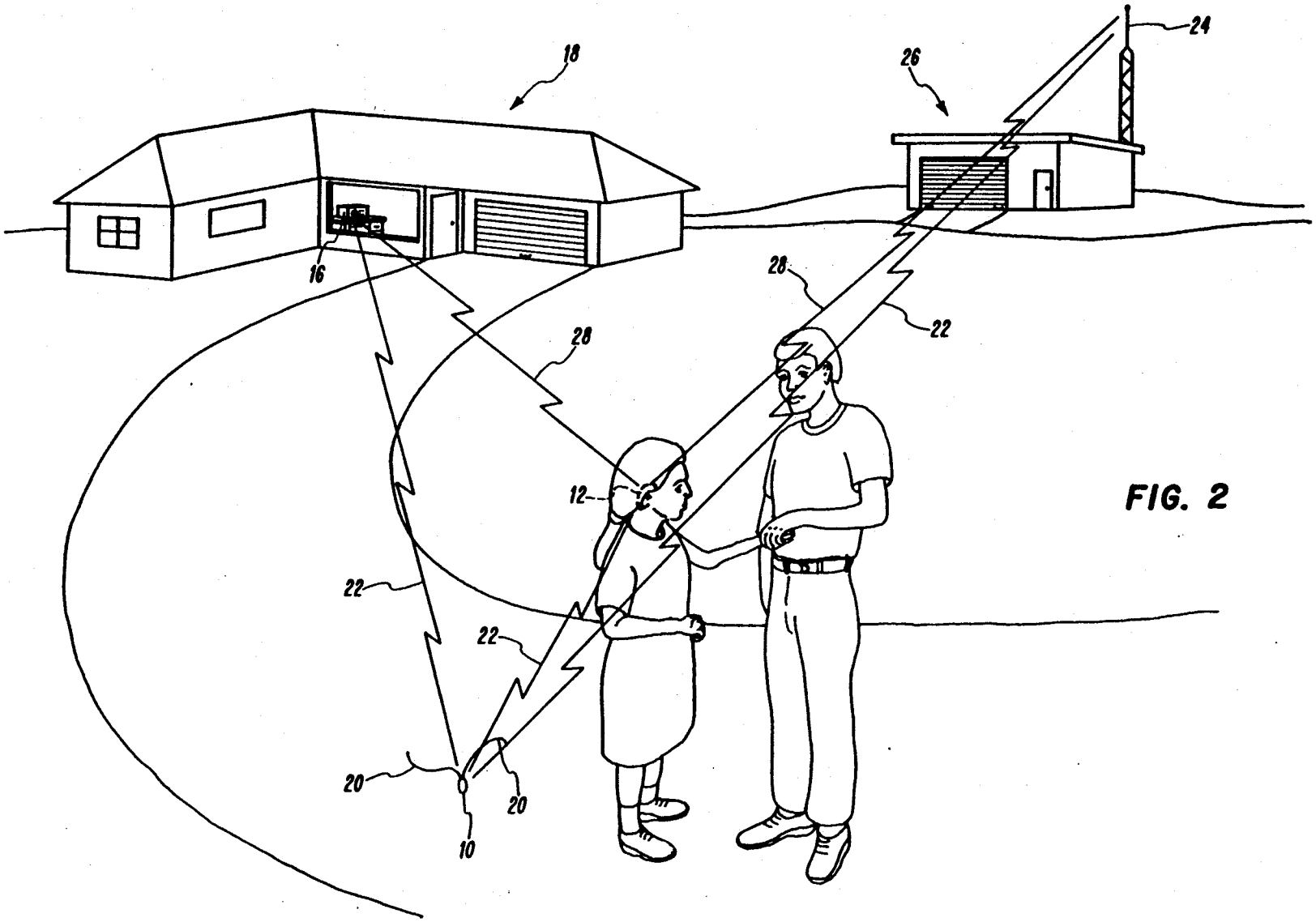
FIG. 2 shows the child in the process of being abducted, with a portion of the apparatus removed from the child's body and a distress signal being transmitted by the apparatus.
Figure 3:
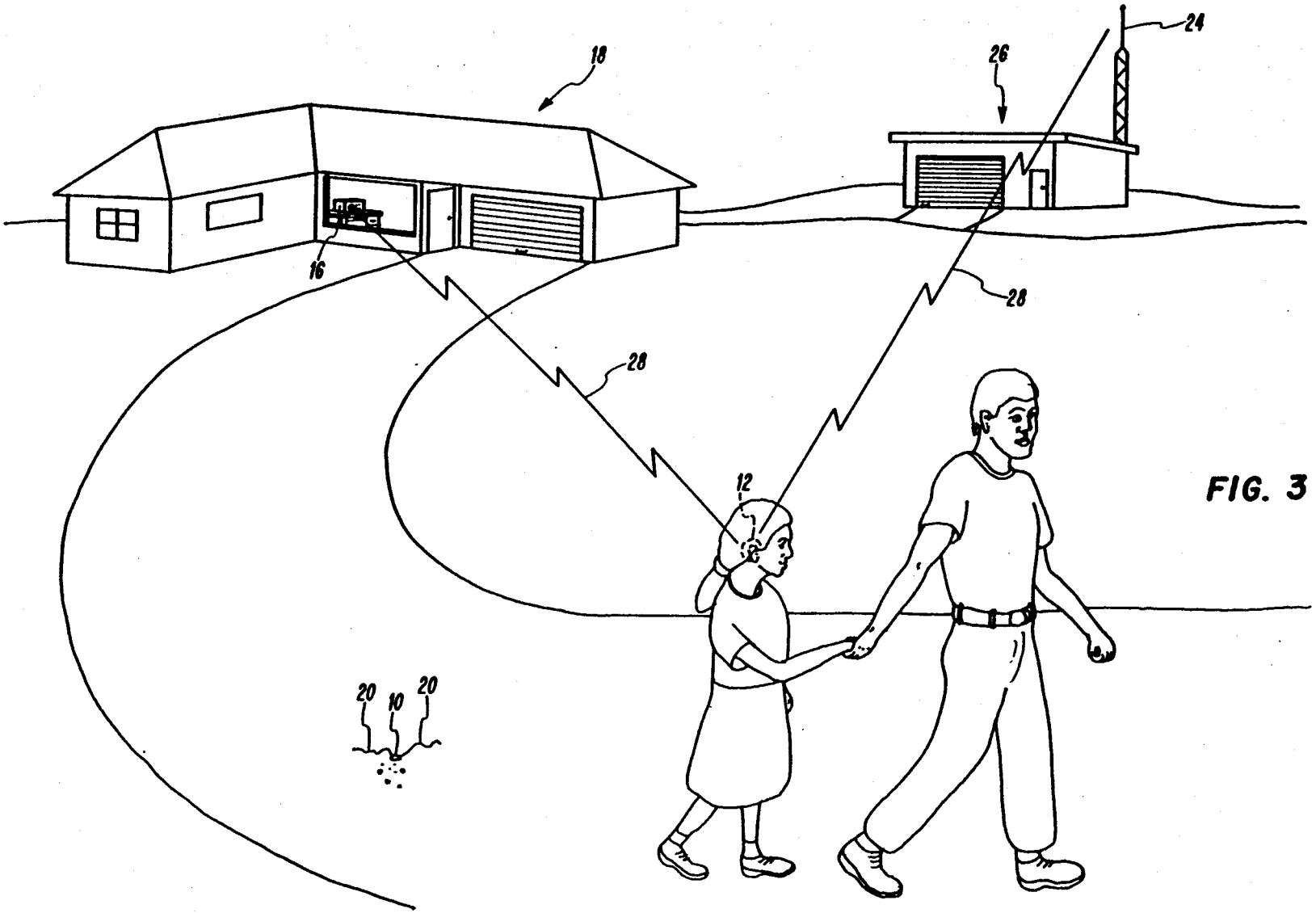
FIG. 3 shows the portion of the apparatus previously removed from the child's body in a broken condition and a distress signal being transmitted by another portion of the apparatus mounted behind the child's ear.
Figure 4:
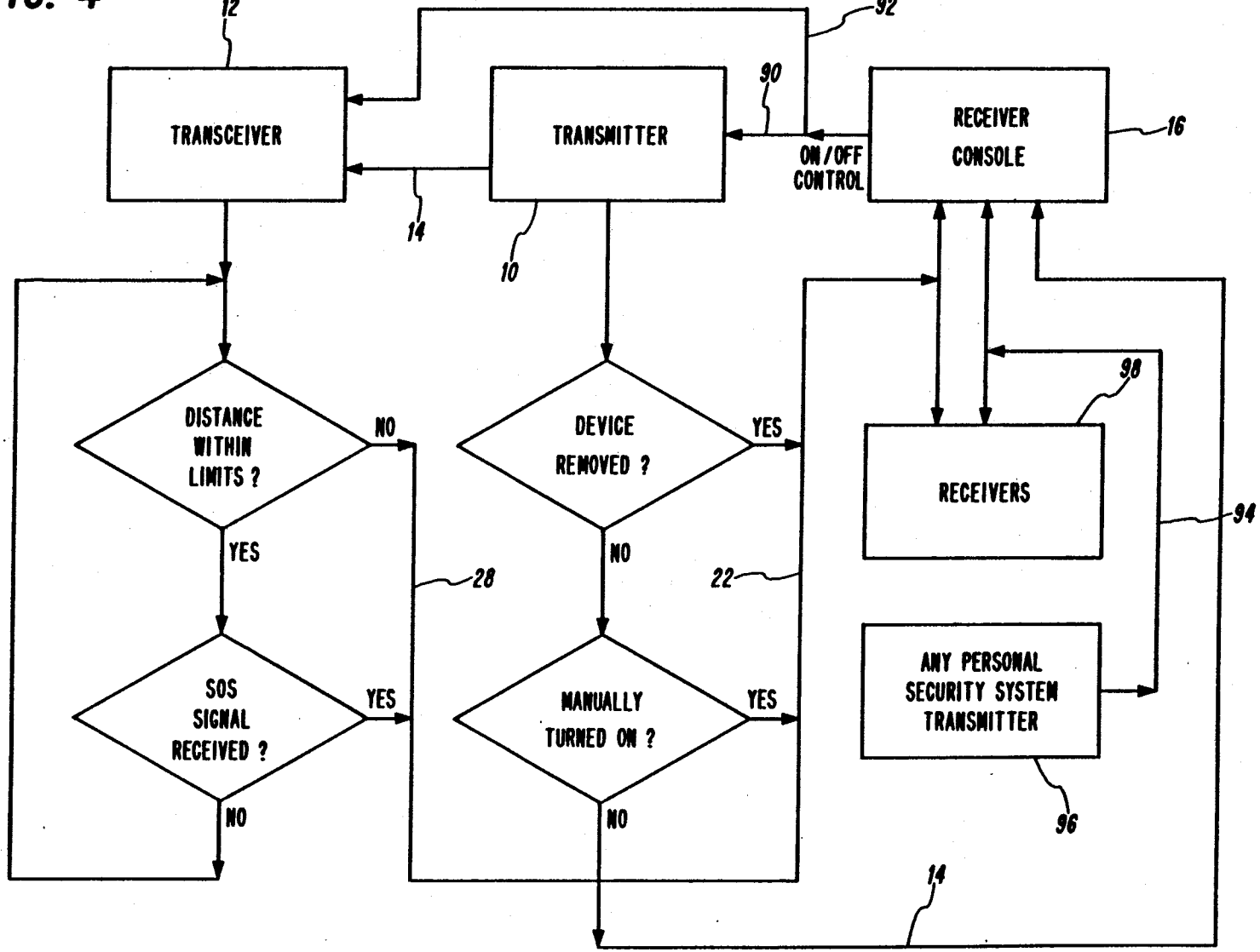
FIG. 4 is a block diagram, illustrating the sequence of operation of the apparatus.

Referring also to FIGS. 2, 3 and 4, the operation of the personal security apparatus is illustrated in response to an abduction of the child by an adult. In FIGS. 2 and 3, transmitter 10 is depicted as having been removed from the child's body, presumably by force exerted by the abductor. The first device further includes an electrical conductor (not shown), which forms a part of a first electrical circuit. The electrical conductor is housed in an insulative jacket 20, which is adapted to be worn around a part of the child's body, such as the child's neck, for suspending transmitter 10. If transmitter 10 is forcibly removed from the child's body, the electrical conductor is likely to be broken, as shown in FIG. 2, which opens the first electrical circuit. Transmitter 10 is responsive to the first electrical circuit being in an open condition for transmitting a second electromagnetic signal 22, which is an "SOS" signal, indicating that the child is in distress. First signal 14 (see FIG. 1) is discontinued at the onset of SOS signal 22. SOS signal 22 is detectable by receiver console 16 and is also received by a receiver antenna 24, which is located at another remote location, such as a police station 26.

The first device also includes a second electrical circuit (not shown in FIGS. 2, 3 or 4), which is normally in an open condition. The second electrical circuit includes a manually depressible switch. The second electrical circuit is closed when the switch is depressed. Transmitter 10 is responsive to the closure of the second electrical circuit, for transmitting SOS signal 22. Therefore, SOS signal 22 is transmitted in response to either an open condition in the first electrical circuit by virtue of the electrical conductor in jacket 20 being broken or by the second electrical circuit being closed by the operation of the switch.

If abduction appears imminent, the child can activate transmitter 10 to transmit SOS signal 22 by pushing the manually operable switch. If the person is not able to operate the switch, the removal of transmitter 10 from the person's body, resulting in the breakage of the electrical conductor inside jacket 20, also activates transmitter 10 to transmit SOS signal 22. Therefore, as shown in FIG. 4, SOS signal 22 is transmitted either by transmitter 10 being removed from the child's body such that the electrical conductor inside jacket 20 is broken, or by transmitter 10 being manually turned o by the child.

Transceiver 12 further includes a signal transmitter, which is responsive to SOS signal 22 for generating a third electromagnetic signal 28, which is also an "SOS" signal, indicating the distress condition. SOS signal 28 is also received by receiver console 16 and antenna 24. Either or both of the SOS signals 22 and 28 indicate that the child is in distress. Because transceiver 12 is adapted to be mounted in a non-conspicuous location, such as behind the child's ear, the abductor is less likely to detect transceiver 12 than transmitter 10. Therefore, even if the abductor recognizes transmitter 10 as being a homing signal device or other type of security device and removes transmitter 10 from the child's body, he is not likely to search for or find transceiver 12. Therefore, the child's location can be continuously monitored from the child's home 18 and from one or more police stations 26 by means of SOS signal 28, even after transmitter 10 has been removed from the child's body.

Figure 6:
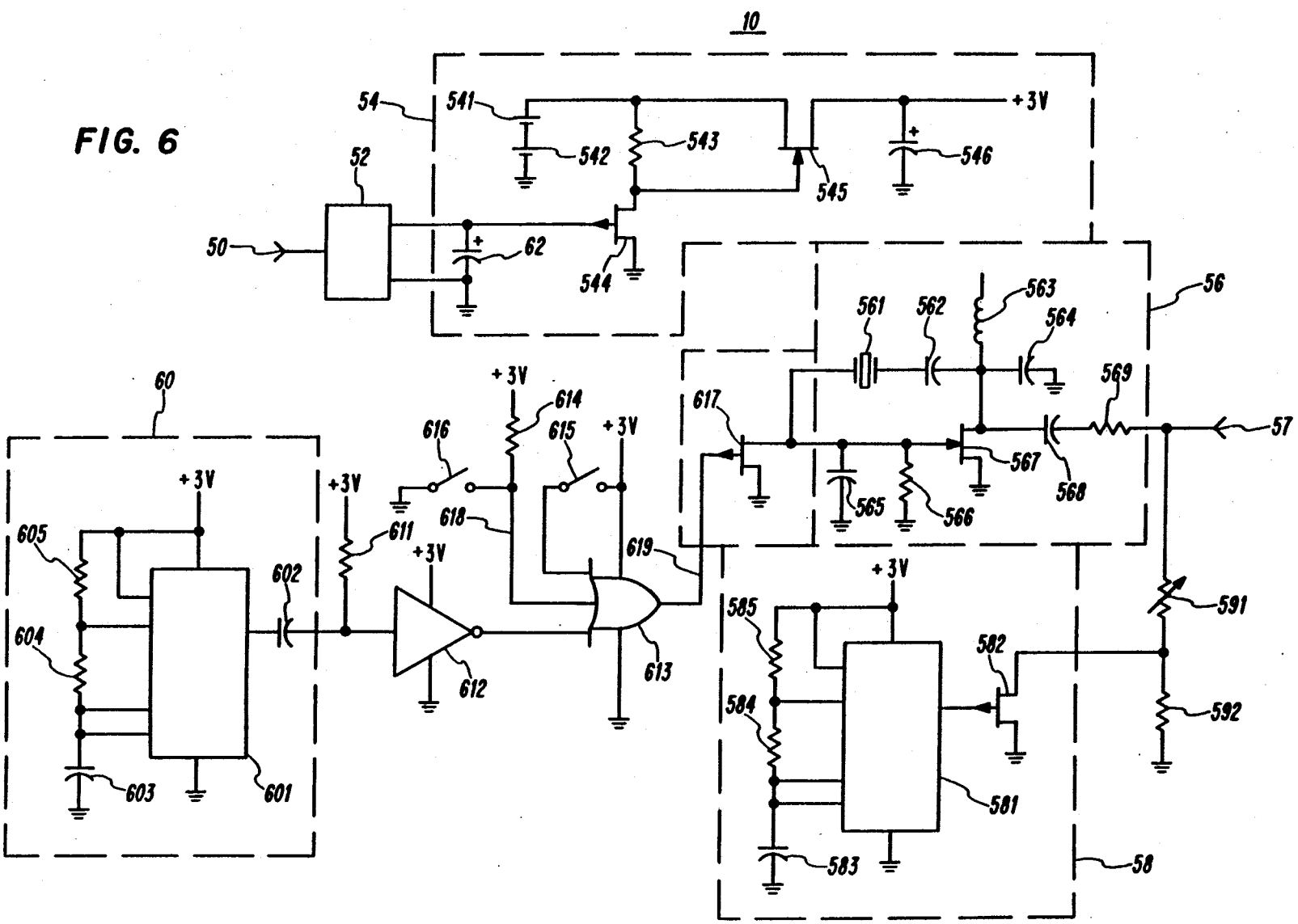
FIG. 6 is an electrical schematic of a transmitter device included in the apparatus.
Figure 7:
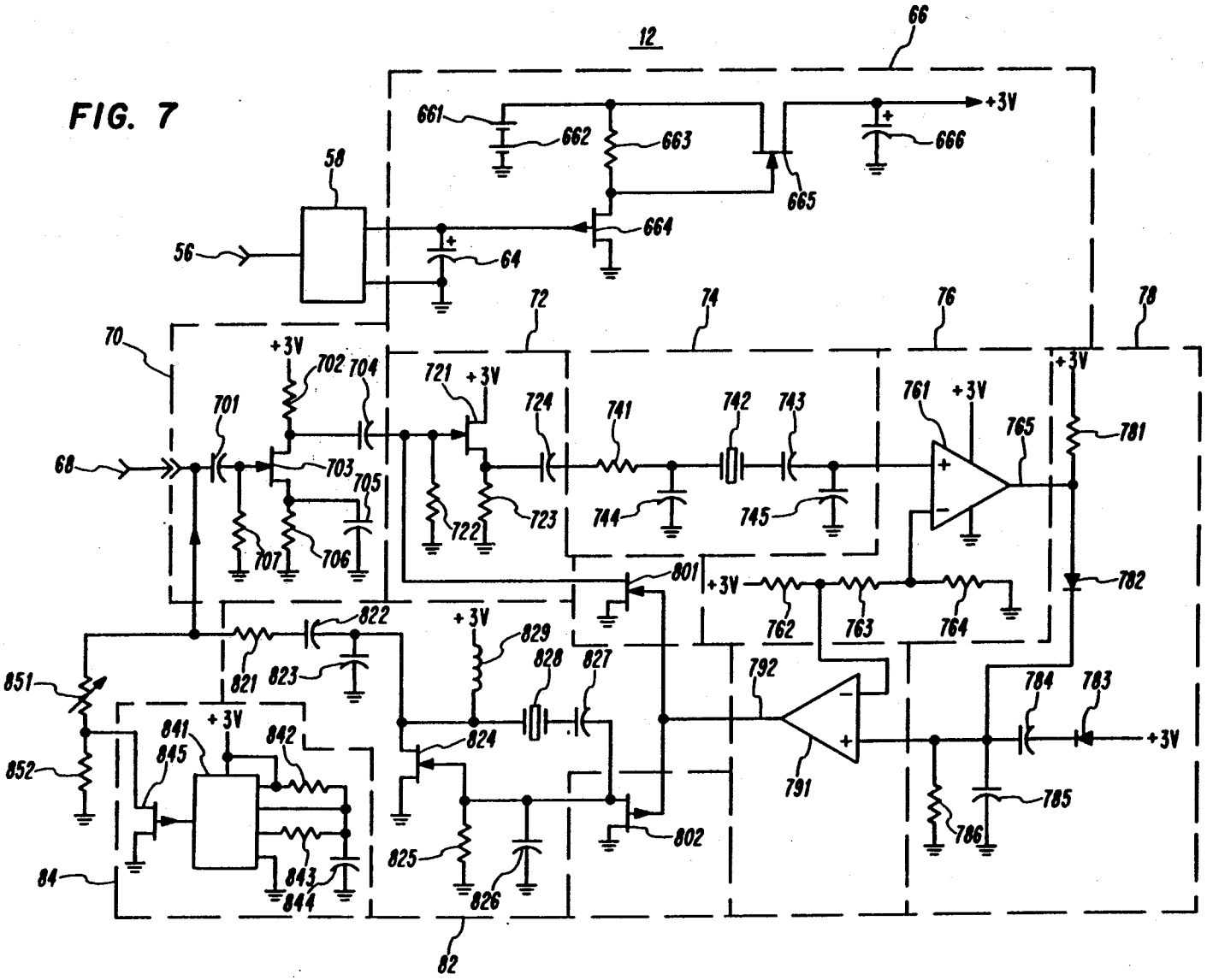
FIG. 7 is an electrical schematic of a transceiver device included in the apparatus.

Referring now to FIG. 3, another possible scenario is depicted. In addition to removing transmitter 10 from the child's body, the abductor may break transmitter 10 into several pieces, as shown in FIG. 3. In that event, transmitter 10 may be completely disabled, such that SOS signal 22 is never transmitted, or is discontinued after being initially transmitted. In accordance with a unique feature of the invention, the transmitter in transceiver 12 is activated to transmit SOS signal 28 when the receiver in transceiver 12 fails to receive first signal 14. Failure to receive signal 14 may be due to first signal 14 not being transmitted or the distance between transmitter 10 and transceiver 12 exceeding the range of signal 14. Therefore, as shown in FIG. 4, SOS signal 28 is transmitted either in response to SOS signal 22 being received by transceiver 12 or in the absence of first signal 14, such as may occur when transceiver 12 is outside the range limit of first signal 14. The electrical circuitry comprising receiver console 16 is shown in FIG. 5; the electrical circuitry comprising transmitter 10 is shown in FIG. 6; and the electrical circuitry comprising transceiver 12 is shown in FIG. 7.

Figure 5:
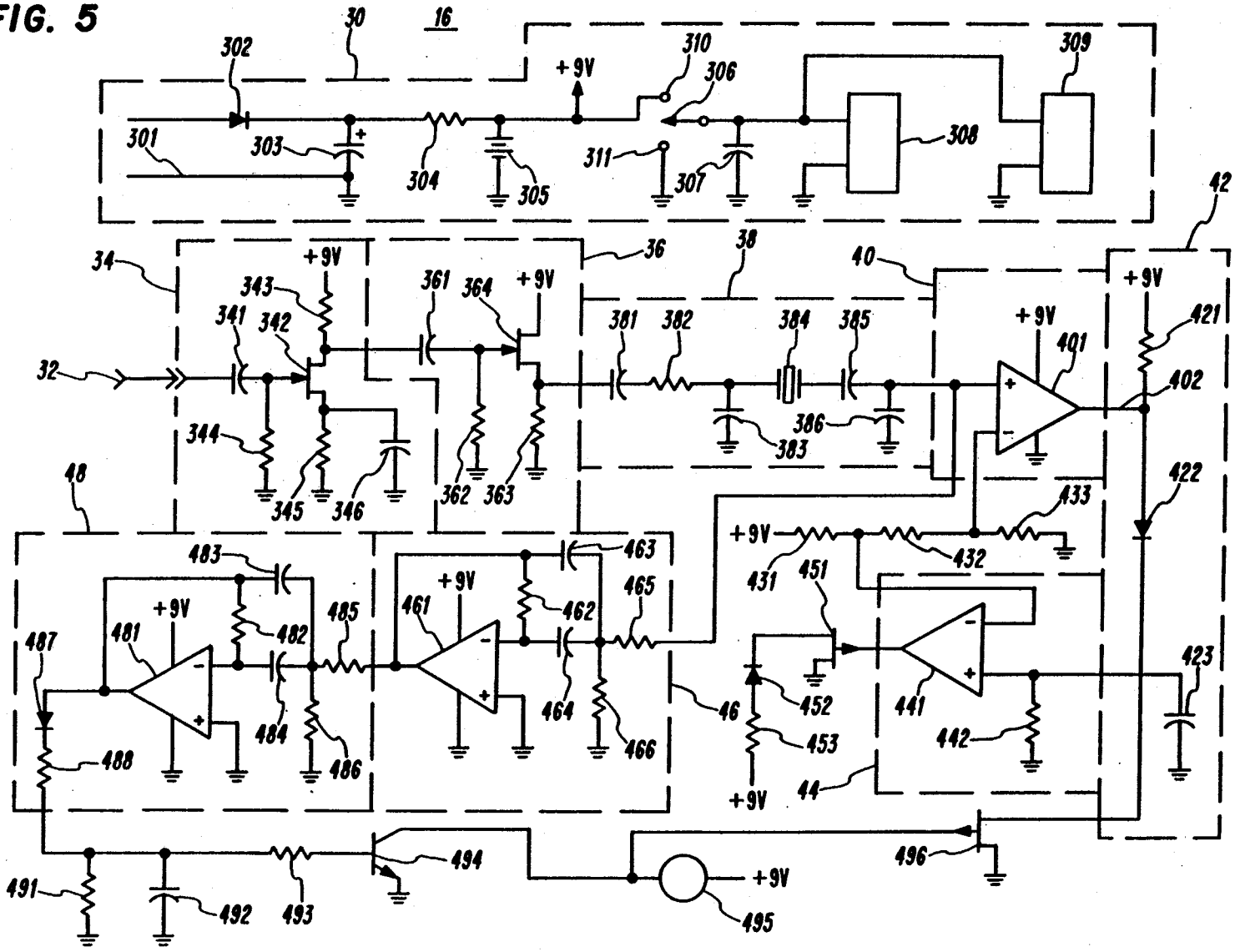
FIG. 5 is an electrical schematic of a remote receiver adapted to receive signals transmitted by the apparatus.

Referring now to FIG. 5, receiver console 16 includes a power supply circuit 30, a whip antenna 32, an RF amplifier circuit 34, a buffer amplifier circuit 36, a crystal filter circuit 38, a first comparator circuit 40, an integration circuit 42, a second comparator circuit 44, a first bandpass filter circuit 46 and a second bandpass filter circuit 48. Power supply circuit 30 includes a power supply conductor 301, which is connected to a source of AC power, such as a 12.6 AC volt wallpack transformer (not shown). Power supply circuit 30 further includes a diode 302, which is preferably of the IN4002 type, manufactured and sold by Texas Instruments Incorporated, a 270 microfarad (uf) capacitor 303, a 300 ohm resistor 304 and a 9 volt NiCad battery 305 for supplying 9 volt DC power to the various components of receiver console 16.

Power supply circuit 30 further includes a two-position switch 306, a 0.1 uf capacitor 307 and first and second coded "N" pin plugs 308 and 309, respectively. Transmitter 10 and transceiver 12 are selectively enabled and disabled by the operation of switch 306. When switch 306 is moved to a first contact position 310

(i.e., the "on" position), 9 volt DC power is supplied to plugs 308 and 309. When switch 306 is "on", plugs 308 and 309 transmit respective "power enable" signals to enable the respective power enable circuits in transmitter 10 and transceiver 12, as will be described in greater detail hereinafter. When switch 306 is moved to a second contact position 311 (i.e., the "off" position), plugs 308 and 309 transmit respective "power disable" signals to disable the respective power enable circuits in transmitter 10 and transceiver 12.

Referring also to FIG. 6, transmitter 10 includes a coded "N" pin plug input 50 for receiving signals from first plug 308 of receiver console 16. Input 50 is connected to a third coded "N" pin plug 52, which controls a power enable circuit 54 of transmitter 10 in response to the power enable and power disable control signals from first plug 308. Transceiver 12 includes a coded "N" pin plug input 56 for receiving power enable and power disable signals from second plug 309 of receiver console 16. A fourth coded "N" pin plug 58 is responsive to the power enable and power disable signals from input 56 for selectively controlling a power enable circuit 66 of transceiver 12, in response to the power enable and power disable signals from second plug 309 of receive console 16.

First and second plugs 308 and 309 each have N number of wires, but only two of the wires are actually used. Since each plug 308, 309 is keyed, it can be inserted in only one direction into power supply circuit 30 of receiver console 16. By randomly selecting which two wires are used, an unauthorized person cannot readily us plugs 308 and 309 to enable or disable transmitter 10 or transceiver 12. Third plug 52 charges a capacitor 62 in power enable circuit 54, in response to a power enable signal from first plug 308. Capacitor 62 remains charged for seven days. In order to disable transmitter 10, first plug 308 must be reinserted into power supply circuit 30 of receiver console 16 and switch 306 moved to off position 311, which results in a power disable signal to third plug 52, thereby disabling transmitter 10. Similarly, fourth plug 58 charges a capacitor 64 in power enable circuit 66, in response to a power enable signal from second plug 309. Transceiver 12 is disabled by reinserting second plug 309 into power supply circuit 30 of receiver console 16 and moving switch 306 to off position 311, which results in a power disable signal to fourth plug 58, thereby disabling transceiver 12.

Referring now to FIG. 5, Rf amplifier circuit 34 includes a 0.001 uf capacitor 341, a 2N4416 type transistor 342, a 20 Kohm resistor 343, a 10 Mohm resistor 344, a 100 Kohm resistor 345 and a 0.001 uf capacitor 346. Buffer amplifier circuit 36 includes a 0.001 uf capacitor 361, a 10 Mohm resistor 362, a 330 ohm resistor 363, and a 2N4416 type transistor 364.

Crystal filter circuit 38 includes a 0.001 uf capacitor 381, a 100 ohm resistor 382, a 200 picofarad (pf) capacitor 383, a 3–5 Mhz crystal filter 384, a 39 pf capacitor 385 and a 300 pf capacitor 386. First comparator circuit 40 is preferably a comparator of the TLC 352 type, manufactured and sold by Texas Instruments Incorporated. Integrator circuit 42 includes a 100 ohm resistor 421, an IN 4148 diode 422 and a 47 uf capacitor 423.

A threshold noise level circuit is comprised of a 47 Mohm resistor 431 and two 1 Mohm resistors 432 and 433, which are coupled to the 9 volt DC power supply. Second comparator circuit 44 includes a comparator 441 of the TLC 352 type and a 47 Mohm resistor 442. The output of comparator 441 is coupled to a J177 type transistor 451, which controls a light emitting diode 452. A 1 Kohm resistor 453 is interposed between diode 452 and the 9 volt DC power supply.

First bandpass filter circuit 46 includes a bandpass filter 461, of the TLC 252 type, manufactured and sold by Texas Instruments Incorporated, a 100 Kohm resistor 462, two 10 uf capacitors 463 and 464, a 5.6 Kohm resistor 465 and 2.2 Kohm resistor 466. Second bandpass filter circuit 48 includes a bandpass filter 481, of the TLC 252 type, a 100 Kohm resistor 482, two 10 uf capacitors 483 and 484, a 5.6 Kohm resistor 485, a 2.2 Kohm resistor 486, an IN4148 type diode 487 and a 100 ohm resistor 488. Receiver console 16 further includes a 1 Mohm resistor 491, a 1000 pf capacitor 492, a 100 Kohm resistor 493, a 2N3904 type transistor 494, an audible alarm 495, which preferably includes a piezoelectric device, and a J177 type transistor 496.

Referring now to FIG. 6 power enable circuit 54 of transmitter 10 further includes two 1.5 volt DC batteries 541 and 542, a 47 Mohm resistor 543, a J177 type transistor 544, a J201 type transistor 545, and a 1 uf capacitor 546. Power enable circuit 54 supplies 3 volt DC power to the various components of transmitter 10.

A crystal oscillator and transmitter circuit 56 includes a 3–5 Mhz crystal oscillator 561, a 0.01 uf capacitor 562, a 1 millihenry (mh) inductor 563, two 100 pf capacitors 564 and 565, a 1 Mohm resistor 566, a 2N4416 type transistor 567, a 0.001 uf capacitor 568 and a 10 Kohm resistor 569. A whip antenna 57 is provided for transmitting the signal generated by transmitter circuit 56 as an electromagnetic signal.

A modulator circuit 58 includes a TLC 551 type timing chip 581, which is manufactured and sold by Texas Instruments Incorporated, a J177 type transistor 582, a 0.1 uf capacitor 583, a 2.7 Mohm resistor 584, and a 4.7 Mohm resistor 585. A 100 Kohm variable resistor 591 and a 1 Kohm resistor 592 are provided for adjusting the power output of the transmitted electromagnetic signal.

A timer circuit 60 is comprised of a TLC 551 type timer chip 601, a 1 uf capacitor 602, a 0.1 uf capacitor 603, a 2.7 Mohm resistor 604 and a 4.7 Mohm resistor 605. Transmitter 10 further includes a 10 Mohm resistor 611, an invertor 612, an OR gate 613, a 47 Mohm resistor 614, a first switch 615 and a second switch 16.

Referring now to FIG. 7, power enable circuit 66 of transceiver 12 includes two 1.5 volt DC batteries 661 and 662, a 47 Mohm resistor 663, a J177 type transistor 664, a J201 type transistor 665 and a 1 uf capacitor 666. Power enable circuit 66 provides 3 volt DC power to transceiver 12.

Transceiver 12 includes a transmit/receive whip antenna 68, which is coupled to an RF amplifier circuit 70. RF amplifier circuit 70 includes a 0.001 uf capacitor 701, a 20 Kohm resistor 702, a 2N4416 type transistor 703, two 0.001 uf capacitors 704 and 705, a 100 Kohm resistor 706 and a 10 Mohm resistor 707.

RF amplifier circuit 70 is coupled to a buffer amplifier circuit 72, which is comprised of a 2N4416 type transistor 721, a 10 Mohm resistor 722, a 330 ohm resistor 723 and a 0.001 uf capacitor 724. Buffer amplifier circuit 72 is coupled to a crystal filter circuit 74. Crystal filter circuit 74 is comprised of a 100 ohm resistor 741, a 3–5 Mhz crystal filter 742, a 39 pf capacitor 743, a 200 pf capacitor 744 and a 300 pf capacitor 745.

A first comparator circuit 76 is comprised of a comparator 761, preferably of the TLC 352 type. A 47

Mohm resistor 762 and two 5.1 Mohm resistors 763 and 764, coupled between the 3 volt DC power supply and ground, comprise a threshold noise level circuit. An integrator circuit 78 includes a 100 ohm resistor 781, two IN4148 type diodes 782 and 783, a 1.0 uf capacitor 784, a 0.01 uf capacitor 785 and a 10 Mohm resistor 786. A second comparator 791, which is preferably of the TLC 352 type, receives an output signal from integrator circuit 78. A J201 type transistor 801 and a J177 type transistor 802 receive the output of second comparator 791.

Transceiver 12 further includes a crystal oscillator and transmitter circuit 82 and a modulator circuit 84. Crystal oscillator and transmitter circuit 82 includes a 10 Kohm resistor 821, a 0.001 uf capacitor 822, a 100 pf capacitor 823, a 2N4416 type transistor 824, a 1 Mohm resistor 825, a 100 pf capacitor 826, a 0.001 uf capacitor 827, a 3-5 Mhz crystal oscillator 828 and a 1 mh inductor 829. Modulator circuit 84 includes a TLC 551 timing chip 841, a 4.7 Kohm resistor 842, a 2.7 Kohm resistor 843, a 0.1 uf capacitor 844, and a J177 type transistor 845. A 100 Kohm variable resistor 851 and 1 Kohm resistor 852 are provided for adjusting the power output of the transmitted signal.

Referring again to FIG. 4, the power enable and power disable signals from receiver console 16 are received by transmitter 10 and transceiver 12, as indicated by respective signal lines 90 and 92. When transmitter 10 is enabled (i.e., turned "on"), transmitter 10 normally transmits first electromagnetic signal 14, which is received by both transceiver 12 and receiver console 16. Referring also to FIG. 6, timer circuit 60 controls a J177 type transistor 617, which functions as a transmitter switch, to intermittently activate transmitter circuit 56, such that transmitter circuit 56, transmits a 10 microsecond (us) signal burst at one second intervals. In normal operation, first switch 615 is in an open state, while second switch 616 is in a closed state. When first switch 615 is open and second switch 616 is closed, timer circuit 60 controls the output of OR gate 613. The output of OR gate 613 in turn controls transmitter switch 617, which results in the 10 us signal burst at one second intervals.

Referring also to FIGS. 4, 5 and 7, integrated circuit 42 of receiver console 16 ignores the 10 us signal burst and transceiver 12 continues to receive the 10 us signal burst at one second intervals. The charge time of resistor 781 and capacitor 785 of the transceiver integrator circuit 78 is less than 10 us and the discharge time through resistor 786 and capacitor 785 is greater than one second. As long as the 10 us signal burst continues every second, transistor 802 remains in an "off" state and transistor 801 remains in an "on" state.

Referring again to FIGS. 4 and 6, if either first switch 615 is closed (such as by manual operation of the person in distress) or second switch 616 is open (resulting from the electrical conductor worn around the person's neck being broken), the output signal of OR gate 613 is no longer controlled by timing circuit 60. Instead, a continuous input signal 618 is fed to OR gate 613, resulting in a continuous output signal 619, which maintains transistor 617 in a continuous "on" state. Transmitter 56 transmits a continuous electromagnetic signal (i.e., SOS signal 22) at a carrier frequency determined by crystal oscillator 561. Modulator circuit 58 modulates the carrier frequency, so that a continuous modulated signal is transmitted by antenna 57.

Referring again to FIGS. 4 and 5, the SOS signal 22 from transmitter 10 is received by both receiver console 16 and transceiver 12. If the incoming signal exceeds the threshold noise level, comparator 401 transmits an output signal 402 to integrator circuit 42. Capacitor 423 integrates the incoming carrier frequency and transistor 451 turns on diode 452. Illumination of diode 452 indicates that receiver console 16 has received a distress signal from a device other than the device being worn by the person whose location is being monitored. The receiver circuitry of console 16 is adapted to receive SOS signals from multiple personal security devices. Although the carrier frequency may be the same for the SOS signals transmitted by various personal security devices, the modulated signal is unique for each security device so that the particular individual in distress can be identified by the discrete modulated signal. Bandpass filter circuits 46 and 48 filter the modulation out of the carrier frequency, so that only the unique modulation associated with the device being worn by the person whose location is being monitored is passed by the filter circuits 46 and 48. Diode 487 detects the modulation and capacitor 492 integrates the modulated signal, which turns on transistor 494. When transistor 494 is turned on, alarm 495 is activated and diode 452 is turned off. Alarm 495 indicates the incoming SOS signal is from the device worn by the individual whose location is being monitored and not from some other security device.

Referring now to FIGS. 4 and 7, comparator 761 generates an output signal 765 in response to the SOS signal 22 received from transmitter 10 when the incoming signal exceeds the threshold noise level. Output signal 765 is integrated by capacitor 785 and the integrated signal is transmitted as an output signal 792 by comparator 791 when the integrated signal exceeds the threshold noise level. Output signal 792 turns on transistor 802 and turns off transistor 801, thereby simultaneously enabling crystal oscillator and transmitter circuit 82 and disabling the receiver circuitry of transceiver 12. Crystal oscillator and transmitter circuit 82 is therefore enabled to transmit a continuous SOS signal, which is modulated by modulator circuit 84 to provide a modulated SOS signal 28. Receiver console 16 is adapted to receive SOS signal 22 from transmitter 10 and SOS signal 28 from transceiver 12, as can be best seen in FIG. 4.

Transceiver 12 is also adapted to transmit SOS signal 28 if transceiver 12 fails to receive the normal signal 14 from transmitter 10. The charge time through resistor 781 and capacitor 785 is less than 10 us and the discharge time through resistor 786 and capacitor 785 is greater than one second. If transceiver 12 does not receive the 10 us signal burst at least once each second, capacitor 785 discharges through resistor 786, which turns on transistor 802 and turns off transistor 801, thereby simultaneously enabling crystal oscillator and transmitter circuit 82 and disabling the receiver circuitry of transceiver 12. Therefore, transceiver 12 is adapted to transmit SOS signal 28 if either SOS signal 22 is received o normal signal 14 is not received. Typically, transceiver 12 will not receive signal 14 when the distance between transceiver 12 and transmitter 10 becomes too great to detect signal 14, which occurs when transmitter 10 has been removed from the person's body and the person has moved or been moved to another location.

Referring now to FIGS. 4 and 5, receiver console 16 is adapted to receive distress signals 94 from other dedicated personal security transmitters 96. As previously described, receiver console 16 will illuminate light emitting diode 452 to indicate the receipt of an SOS signal other than from the particular personal security device being worn by the person whose location is being monitored by receiver console 16. By the same token, SOS signals 22 and 28 are detectable by other receivers 98 at other remote locations. Such other remote receivers 98 may include receivers located at police stations or in other private homes, so that a network of receivers is provided for monitoring a plurality of personal security devices.

In accordance with the present invention, a personal security apparatus is provided, whereby the location of an individual can be continuously monitored from a remote location. The apparatus includes a body mountable transmitter and a body mountable transceiver, both of which are adapted to transmit distress signals under certain conditions. Therefore, one can not only monitor the location of the individual wearing the transmitter and transceiver, but can also determine whether or not the person is in distress.

Various embodiments of the invention have now been described in detail. Since it is obvious that many changes in and additions to the above-described preferred embodiment may be made without departing from the nature, spirit and scope of the invention, the invention is not to be limited to said details, except as set forth in the appended claims.

What is claimed is:

1. An apparatus comprised of first and second devices mountable at respective first and second locations on a person's body, said first device including a first transmitter for normally transmitting a first electromagnetic signal, said first transmitter being responsive to a first predetermined condition for transmitting a second electromagnetic signal in lieu of said first signal, said second device including a receiver for receiving said first and second signals and a second transmitter for transmitting a third electromagnetic signal in response to a second predetermined condition, said second predetermined condition being indicated by either said second signal being received by said receiver or said first signal not being received by said receiver, at least said second and third signals being detectable by a remote receiver.

2. The apparatus of claim 1 wherein said first device includes first and second electrical switches, said first transmitter being responsive to said first switch being closed and said second switch being open for generating said first signal, said first predetermined condition being indicated by either said first switch being open or said second switch being closed.

3. The apparatus of claim 2 wherein said second switch is normally open, said second switch being manually closable, said first switch being normally closed and being opened by the removal of said first device from the person's body.

4. The apparatus of claim 1 wherein said first device includes first and second electrical circuits, said first electrical circuit including an electrical conductor housed in an insulative jacket, which is adapted to be worn around a part of the person's body, said second circuit including a manually operable switch which is normally open, said second signal being transmitted by said first transmitter in response to either said electrical conductor being broken or said switch being closed.

5. The apparatus of claim 1 wherein said first device includes a manually operable switch which is normally open, said second signal being transmitted by said first transmitter in response to said switch being closed.

6. The apparatus of claim 1 wherein said first device includes an electrical circuit having an electrical conductor housed in an insulative jacket, said jacket being adapted to be worn around a part of the person's body, said second signal being transmitted by said first transmitter in response to said electrical conductor being broken.

7. The apparatus of claim 1 wherein said first, second and third signals ar detectable by a remote receiver.

8. The apparatus of claim 1 wherein said second device includes means for simultaneously enabling said second transmitter to transmit said third electrical signal and disabling said receiver in response to said second predetermined condition.

9. Apparatus for monitoring the location of a person, comprising, in combination:

transmitter means for normally transmitting a first electromagnetic signal, said transmitter means being adapted to be worn by the person, said transmitter means being responsive to a first predetermined condition for transmitting a second electromagnetic signal in lieu of said first signal;

transceiver means for receiving said first and second signals and for transmitting a third electromagnetic signal in response to a second predetermined condition, said second predetermined condition being indicated by either said second signal being received by said transceiver means or said first signal not being received by said transceiver means, said transceiver means being adapted to be worn by the person at a separate location on the person's body from said transmitter means; and remote receiver means adapted to receive the second and third signals.

10. The apparatus of claim 9 wherein both said first and second predetermined conditions indicate that the person is in distress.

11. The apparatus of claim 9 wherein said remote receiver means includes alarm means for generating an alarm signal in response to the receipt of either or both of the second and third signals by said remote receiver means.

12. The apparatus of claim 9 wherein said remote receiver means is adapted to receive said first, second and third signals.

13. The apparatus of claim 9 wherein said transceiver means includes a transmitter portion and a receiver portion, said transceiver means further including means for simultaneously enabling said transmitter portion to transmit said third signal and disabling said receiver portion in response to said first predetermine condition.

14. The apparatus of claim 9 wherein said remote receiver means includes means for selectively enabling and disabling said transmitter means and said transceiver means.

15. The apparatus of claim 9 wherein said transmitter means includes first and second electrical switches, said transmitter means being responsive to said first switch being closed and said second switch being open for generating said first signal, said first predetermined condition being indicated by either said first switch being open or said second switch being closed.

16. The apparatus of claim 15 wherein said second switch is normally open, said second switch being manually closable, said first switch being normally closed, said first switch being opened by the removal of said transmitter means from the person's body.

17. The apparatus of claim 9 wherein said transmitter means includes first and second electrical circuits, said first electrical circuit having an electrical conductor housed in an insulative jacket, which is adapted to be worn around a part of the person's body, said second electrical circuit including a manually operable switch which is normally open, said second signal being transmitted by said transmitter means in response to either said electrical conductor being broken or said switch being closed.

18. The apparatus of claim 9 wherein said transmitter means includes a manually operable switch which is normally open, said second signal being transmitted by said transmitter means in response to said switch being closed.

19. The apparatus of claim 9 wherein said transmitter means includes an electrical circuit having an electrical conductor housed in an insulative jacket, which is adapted to be worn around a part of the person's body, said second signal being transmitted by said transmitter means in response to said electrical conductor being broken.

20. Apparatus for monitoring the location of a person, comprising, in combination:

transmitter means having a first transmitter for normally transmitting a first electromagnetic signal, said first transmitter being responsive to a first predetermined condition indicating that the person is in distress for transmitting a second electromagnetic signal in lieu of the first signal, said transmitter means being adapted to be worn by the person;

transceiver means having a receiver for receiving said first and second signals and a second transmitter for transmitting a third electromagnetic signal in response to a second predetermined condition indicating that the person is in distress, said second predetermined condition being indicated by either said second signal being received by said receiver or said first receiver not being received by said receiver, said transceiver means including means for simultaneously enabling said second transmitter to transmit said third signal and disabling said receiver in response to said first predetermined condition, said transceiver means being adapted to be worn by the person at a different location on the person's body from the transmitter means; and remote receiver means located at a remote location from said transmitter means and said transceiver means for receiving said first, second and third signals and for generating an alarm signal in response to either or both of said second and third signals.

* * * * *